US007762219B2

(12) United States Patent
Shuttleworth

(10) Patent No.: US 7,762,219 B2
(45) Date of Patent: Jul. 27, 2010

(54) RECIRCULATION SYSTEM FOR MOTOR

(75) Inventor: Richard Jack Shuttleworth, Nelson (NZ)

(73) Assignee: Shuttleworth Axial Motor Company, Nelson (NZ)

( * ) Notice: Subject to any disclaimer, the term of this patent is extended or adjusted under 35 U.S.C. 154(b) by 576 days.

(21) Appl. No.: 10/590,337

(22) PCT Filed: Feb. 7, 2005

(86) PCT No.: PCT/NZ2005/000011

§ 371 (c)(1),
(2), (4) Date: Jun. 22, 2007

(87) PCT Pub. No.: WO2005/080781

PCT Pub. Date: Sep. 1, 2005

(65) Prior Publication Data

US 2007/0295008 A1 Dec. 27, 2007

(30) Foreign Application Priority Data

Feb. 23, 2004 (NZ) ..... 531314

(51) Int. Cl.
*F02B 75/20* (2006.01)

(52) U.S. Cl. ..... 123/58.8

(58) Field of Classification Search ..... 123/58.8
See application file for complete search history.

(56) References Cited

U.S. PATENT DOCUMENTS

| | | | | |
|---|---|---|---|---|
| 4,475,524 | A | 10/1984 | Eckert et al. | |
| 4,787,343 | A | 11/1988 | Tuckey | |
| 5,647,309 | A | 7/1997 | Avery | |
| 5,782,226 | A | 7/1998 | Gartner | |
| 6,386,154 | B1 * | 5/2002 | Hellman et al. | 123/58.8 |
| 6,427,644 | B1 | 8/2002 | Dabadie et al. | |
| 6,431,128 | B1 | 8/2002 | Dabadie | |

FOREIGN PATENT DOCUMENTS

| | | |
|---|---|---|
| EP | 0682743 | 11/1995 |
| EP | 0953745 | 11/1999 |
| GB | 2038936 | 7/1980 |
| JP | 200452694 | 2/2004 |
| WO | 9428300 | 12/1994 |
| WO | 9934108 | 7/1999 |
| WO | 03008785 | 1/2003 |
| WO | 03/040530 | 5/2003 |

* cited by examiner

*Primary Examiner*—Noah Kamen
(74) *Attorney, Agent, or Firm*—Dann, Dorfman, Herrell and Skillman, P.C.

(57) ABSTRACT

A motor has an engine block with cylinders arranged to fire in a firing order. A recirculation system delivers combusted mixture from a cylinder which has just fired to at least partly mix with fuel for the next cylinder in the firing order. Injector bodies (401-405) are associated with each cylinder. Each injector body (401-405) has an internal chamber (424) in communication with a fuel inlet port (426) for delivering fuel into the internal chamber, a fuel outlet port (428) for delivering fuel under pressure from the chamber into the associated cylinder and a combusted mixture out-let port (442). The combusted mixture outlet port (442) of each injector body (401-405) is fluidly connected to the combusted mixture inlet port (438) of the next cylinder in the firing order. Alternatively, the recirculation system is arranged substantially internally within the cylinder head.

34 Claims, 7 Drawing Sheets

RECIRCULATION SYSTEM FOR MOTOR

FIELD OF THE INVENTION

The present invention relates to a recirculation system for a motor or engine and to a motor or engine incorporating the recirculation system. While the invention has application for axial motors, it also has applications for other motors. The term "motor" is used interchangeably with "engine".

BACKGROUND TO THE INVENTION

Over the years engine manufacturers have been working to improve the weight, size efficiency and manufacturing costs of engines. In part this has lead to the development of axial motors. An axial motor includes an engine block in which the cylinders are spaced evenly in a circular configuration about an axis of the engine block, rather than in the inline, "V" or horizontally opposed configurations of traditional engines. The reciprocal motion of the pistons in an axial motor can be transferred to rotational motion of an output shaft by way of a wobble plate configuration, such as that disclosed in NZ 221336.

Generally, as with conventional internal combustion engines, the compression ratio and therefore power output of the axial motor is at least in part limited by the quality of the fuel being burnt. If poor quality fuel is used, a lower compression ratio must be used in the motor or else "knocking" or auto-igniting will occur, which ultimately could damage components of the motor. Some higher density fuels ("heavy" fuels) such as diesel hydrocarbon fuel exhibit poor combustion properties as they are difficult to atomise prior to combustion, compared to lower density fuels ("light" fuels) such as petrol.

A number of internal combustion engines are configured to deliver exhaust gas under relatively low pressure to cylinders to go some way towards improving combustion properties and/or reducing emissions. Such engines are described in U.S. Pat. No. 6,427,644; U.S. Pat. No. 5,782,226; U.S. Pat. No. 4,475,524 and EP 0682743.

WO 03/008785 and WO 03/040530 to Scuderi describe four stroke split cycle internal combustion engines. The engines have a compression cylinder containing a compression piston and a power cylinder containing a power piston. The compression piston performs the intake and compression strokes of a four stroke cycle, and the power piston performs the power and exhaust strokes of the same four stroke cycle. A fresh air/fuel mixture is compressed in the compression cylinder and is delivered via a gas passage to the combustion cylinder for combustion, and then exhausted from the engine. The two pistons are provided so that the power piston can be offset to align the maximum combustion pressure with the maximum torque applied to the crank shaft, and so that the compression piston can be offset to align the maximum compression with the maximum torque applied from the crank shaft. The Scuderi systems do not address compression ratio issues. Only fresh compressed mixture is shared between cylinders.

It is an object of the present invention to provide a recirculation system for a motor which is operable to improve combustion properties and improve performance and/or which at least provides the public with a useful choice.

SUMMARY OF THE INVENTION

In accordance with a first aspect of the present invention, there is provided a motor comprising: an engine block with a plurality of cylinders arranged to fire with a firing order; and a recirculation system configured to deliver combusted mixture under combustion pressure and temperature from a cylinder which has just fired to at least partly mix with fuel for the next cylinder in the firing order to improve the combustion properties of the fuel.

It should be noted that where reference herein is made to "combusted mixture under combustion temperature and pressure", that need not mean that the temperature and pressure will be at the same levels as at the time of combustion, as pressure and temperature losses will occur during transfer of the mixture. However, the mixture will be at a significantly elevated temperature and pressure relative to any combustible mixture in the next cylinder in the firing order.

The term 'comprising' as used in this specification and claims means 'consisting at least in part of', that is to say when interpreting statements in this specification and claims which include that term, the features prefaced by that term in each statement all need to be present but other features can also be present.

In accordance with a second aspect of the present invention, there is provided a motor comprising: an engine block with a plurality of cylinders arranged to fire with a firing order; and a recirculation system comprising fluid transfer paths which are arranged to provide a fluid connection between cylinders sequentially in the firing order of the motor, the motor configured such that combustion in a cylinder creates a combusted mixture having a combustion pressure, which combustion pressure forces some of that combusted mixture to at least partly mix with fuel for the next cylinder in the firing order to improve the combustion properties of the fuel.

In one embodiment, each cylinder has an injector body associated therewith, with each injector body having an internal chamber in communication with a fuel inlet port for delivering fuel into the internal chamber, a fuel outlet port for delivering fuel under pressure from the chamber into the associated cylinder, a mixture inlet port and a mixture outlet port, with the mixture inlet port of each injector body in fluid communication with the mixture outlet port of an injector body associated with the immediately preceding cylinder in the firing order of the motor, the motor configured to deliver combusted mixture under combustion pressure and temperature from an outlet port of an injector body associated with a cylinder that has just fired to an inlet port of an injector body associated with the next cylinder in the firing order of the motor to at least partly mix with fliel in the internal chamber of the injector body associated with said next cylinder in the firing order to improve the combustion properties of the fuel.

The fuel inlet port of each injector body is preferably configured for receipt of a respective fuel injector.

Advantageously, each mixture inlet port comprises a non-return valve which allows the mixture to travel into the internal chamber through the port but not out of the internal chamber through the port.

Preferably, each mixture outlet port comprises a non-return valve which allows mixture to travel out of the internal chamber through the port but not into the internal chamber through the port.

Suitably, each fuel inlet port comprises a non-return valve which allows fuel to flow into the internal chamber through the fuel inlet port, but not out of the internal chamber through the fuel inlet port.

Transfer paths are preferably provided to fluidly connect the mixture outlet port of each injector body with the mixture inlet port of the injector body associated with the next cylinder in the firing order. The transfer paths may be pipes, tubes, or the like.

In an alternative embodiment, the recirculation system is arranged substantially internally within a cylinder head of the motor. Preferably, the cylinder head comprises a pre-mix chamber is associated with each cylinder, and the cylinder head includes transfer paths configured to deliver combusted mixture under combustion pressure and temperature from the pre-mix chamber associated with a cylinder that has just fired to the pre-mix chamber associated with the next cylinder in the firing order. Preferably, each transfer path comprises at least one non-return valve configured to allow combusted mixture under combustion pressure and temperature to be delivered to the pre-mix chamber associated with the next cylinder in the firing order.

It is preferred that a fluid path is provided between each pre-mix chamber and the respective cylinder, and preferably the fluid path includes a nozzle to deliver mixture for combustion into the respective cylinder under pressure.

The motor may be an inline, "V", or horizontally opposed ("boxer") configuration two- or four-stroke internal combustion motor. Alternatively, the motor may be a two- or four-stroke axial motor. The system could also be used with a rotary engine.

In the two-stroke embodiment, the motor is preferably configured such that the combusted mixture is delivered to at least partly mix with the fuel for the next cylinder in the firing order as the piston in said next cylinder is nearing the top of its compression stroke. Preferably, the motor is configured such that when a cylinder is on its compression stroke, some uncombusted air/fuel mixture is delivered under relatively low pressure to the next cylinder in the firing order as said next cylinder is undergoing its compression stroke.

In a preferred embodiment the motor is configured to deliver some uncombusted mixture from a cylinder as its piston is undergoing a compression stroke to a fluid transfer path which provides a fluid connection between that cylinder and the following cylinder in the firing order, such that when combustion occurs in the cylinder, the combusted mixture from that cylinder forces the uncombusted mixture from the transfer path to mix with fuel for the next cylinder in the firing order.

In accordance with a third aspect of the present invention, there is provided a recirculation system for a motor having a plurality of cylinders arranged to fire with a firing order, comprising: a plurality of fuel injector bodies, each injector body having an internal chamber in communication with a fuel inlet port for delivering fuel into the internal chamber, a fuel outlet port for delivering fuel under pressure into an associated cylinder, a mixture inlet port and a mixture outlet port, and arranged with the mixture inlet port of each injector body in fluid communication with the mixture outlet port of an injector body associated with the immediately preceding cylinder in the firing order of the motor; the recirculation system configured to deliver combusted mixture from an outlet port of an injector body associated with a cylinder that has just fired to an inlet port of the injector body associated with the next cylinder in the firing order to at least partly mix with fuel in the internal chamber of that next injector body to improve the combustion properties of the fuel.

The fuel inlet port of each injector body may be configured for receipt of a respective fuel injector.

Preferably, each mixture inlet port comprises a non-return valve which allows the mixture to travel into the internal chamber through the port but not out of the internal chamber through the port.

Preferably, each mixture outlet port comprises a non-return valve which allows mixture to travel out of the internal chamber through the port but not into the internal chamber through the port.

Each fuel inlet port may comprise a non-return valve which allows fuel to flow into the internal chamber through the fuel inlet port, but not out of the internal chamber through the fuel inlet port.

Preferably, the mixture outlet port of each injector body is fluidly connected to the mixture inlet port of the injector body associated with the next cylinder in the firing order of the motor by a transfer path. Each transfer path may comprise a pipe or tube.

The recirculation system is preferably configured such that the combusted mixture at least partly atomises the fuel in the internal chamber to which the combusted mixture has been delivered under combustion pressure and temperature.

In accordance with a fourth aspect of the present invention, there is provided a method of enhancing combustion in a motor having an engine block with a plurality of cylinders arranged to fire with a firing order, comprising delivering combusted mixture under combustion pressure and temperature from a cylinder which has just fired to at least partly mix with fuel for the next cylinder in the firing order to improve the combustion properties of the fuel.

Preferably, each cylinder has an injector body associated therewith, with each injector body having an internal chamber in communication with a fuel inlet port for delivering fuel into the internal chamber, a fuel outlet port for delivering fuel under pressure from the chamber into the associated cylinder, a mixture inlet port and a mixture outlet port, with the mixture inlet port of each injector body in fluid communication with the mixture outlet port of an injector body associated with the immediately preceding cylinder in the firing order of the motor; and wherein the method comprises delivering combusted mixture under combustion pressure and temperature from an outlet port of an injector body associated with a cylinder that has just fired to an inlet port of an injector body associated with the next cylinder in the firing order of the motor to at least partly mix with fuel in the internal chamber of that adjacent injector to improve the combustion properties of the fuel.

Transfer paths may be provided to link the mixture outlet port of each injector body with the mixture inlet port of the injector body associated with the next cylinder in the firing order, and the step of delivering combusted mixture under combustion pressure and temperature from an outlet port of an injector body associated with a cylinder that has just fired to an inlet port of an injector body associated with the next cylinder in the firing order of the motor, may comprise transferring the combusted mixture via the respective transfer path.

The recirculation may occur internally within a cylinder head of the motor. Preferably, a pre-mix chamber is associated with each cylinder, and the method comprises delivering combusted mixture under combustion pressure and temperature from the pre-mix chamber associated with a cylinder that has just fired to the pre-mix chamber associated with the next cylinder in the firing order. The method preferably comprises delivering mixture for combustion from each pre-mix chamber into the respective cylinder under pressure.

In a preferred embodiment, the motor may be configured to operate in a two-stroke configuration, and the step of delivering combusted mixture under combustion pressure and temperature from a cylinder which has just fired to at least partly mix with fuel for the next cylinder in the firing order occurs as the piston in said next cylinder is nearing the top of its compression stroke. Preferably the method comprises delivering from a cylinder on its compression stroke some uncombusted air/fuel mixture under relatively low pressure to the next cylinder in the firing order as said next cylinder is undergoing its compression stroke.

Preferably, the method comprises delivering some uncombusted mixture from a cylinder as its piston is undergoing a compression stroke to a fluid transfer path which provides a fluid connection between that cylinder and the following cylinder in the firing order, such that when combustion occurs in the cylinder, the combusted mixture from that cylinder forces the uncombusted mixture from the transfer path to mix with fuel for the next cylinder in the firing order.

BRIEF DESCRIPTION OF THE DRAWINGS

Preferred embodiments of the invention will be described with reference to the accompanying drawings in which.

DETAILED DESCRIPTION OF THE PREFERRED EMBODIMENTS

Figure 1:
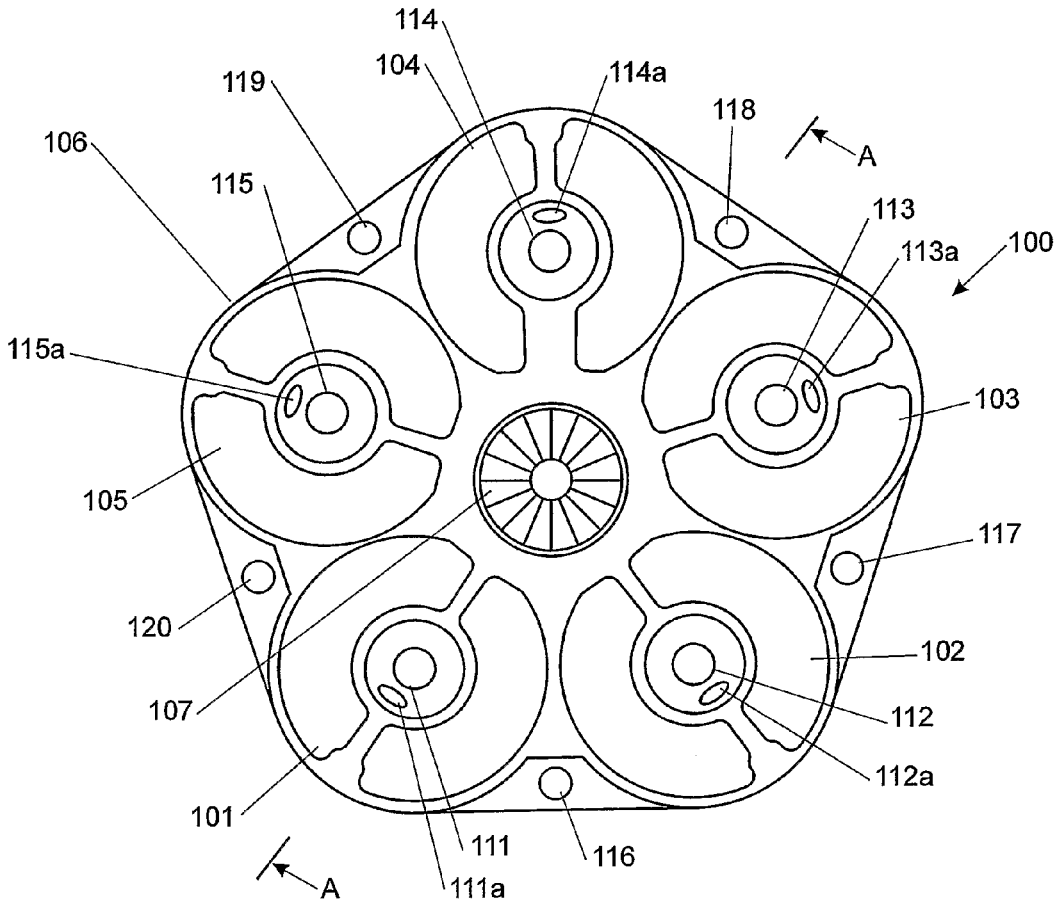
FIG. 1 is a plan view of an engine block of an axial motor which may be used with the recirculation system of the present invention.
Figure 2:
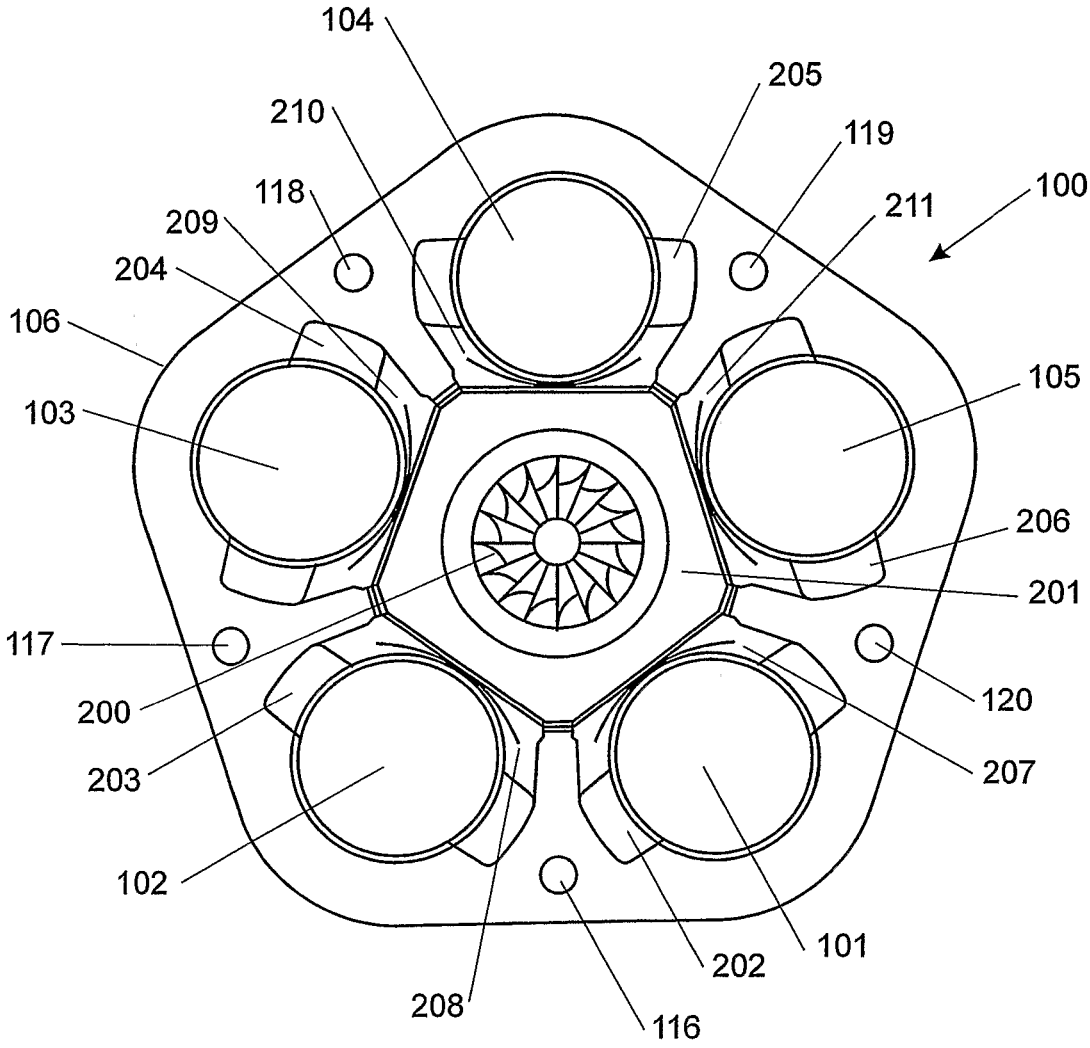
FIG. 2 is a part diagrammatical plan view of the engine block from the opposite end of FIG. 1 with an air chest cover removed, showing a radial compressor.
Figure 3:
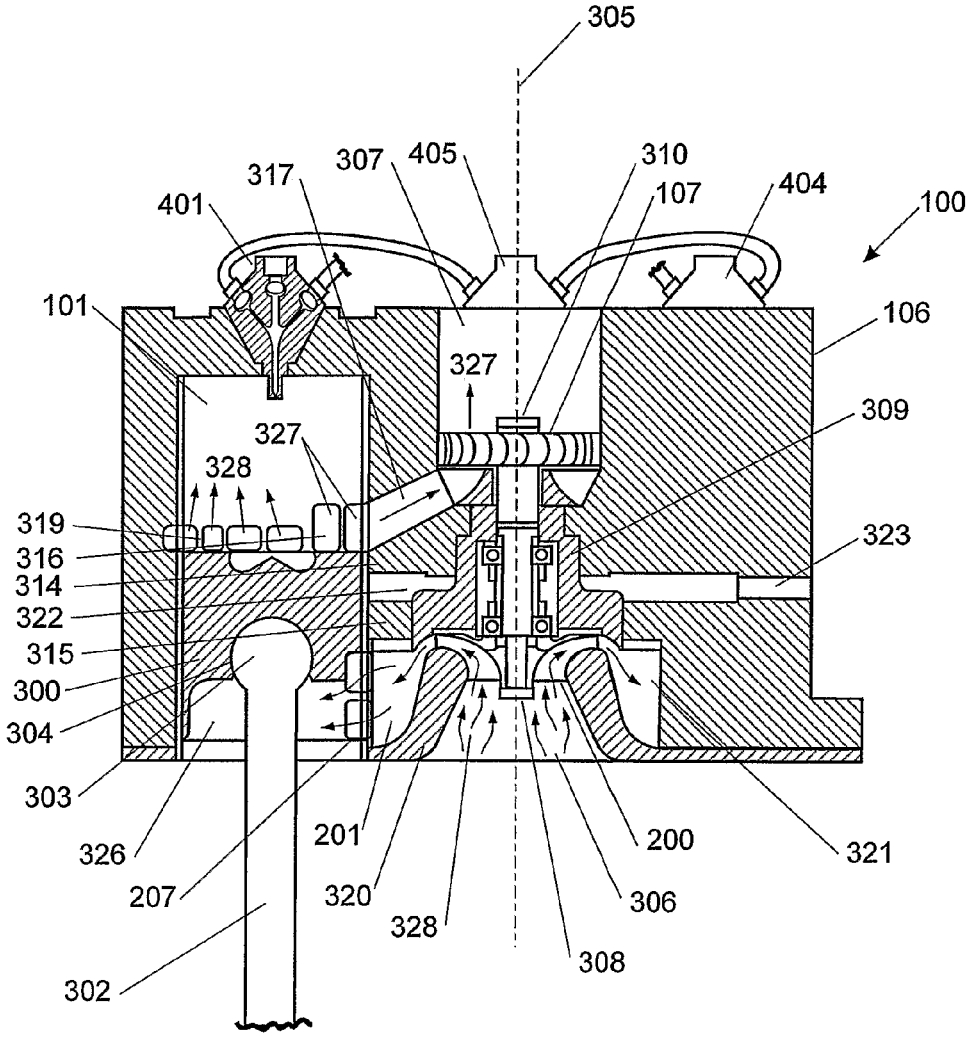
FIG. 3 is a section through a multi-cylinder axial engine block showing the turbocharger and one cylinder and part of the recirculation system of one embodiment of the present invention, on a view through line A-A of FIG. 1.

FIGS. 1 to 3 show an axial two-stroke motor which may be used with the recirculation system of the preferred embodiment of the present invention. The general motor arrangement and operation will be described first.

FIG. 1 shows a top plan view of the axial two-stroke motor which includes an integral turbocharger. The axial two-stroke motor or engine 100 includes an engine block 106 preferably formed as an aluminium casting into which have been machined a plurality of cylinders 101-105. The cylinders are arranged in a substantially circular arrangement about a longitudinal axis 305 of the engine block 106 such that the cylinders are spaced substantially evenly about the axis 305. The longitudinal axis 305 is illustrated in FIG. 3. In the preferred embodiment there are five cylinders 101-105 in the motor. More or less cylinders could be provided as is desirable.

The axial-two stroke motor 100 shown includes a turbocharger 308 which is disposed substantially within the engine block 106. Preferably the turbocharger 308 is aligned with the axis 305 of the engine block 106 such that it is surrounded by the evenly spaced cylinders 101-105.

FIG. 1 shows an end view of the turbocharger 308 in which an exhaust turbine 107 which forms part of the turbocharger is visible. This illustrates that the location of the turbocharger 308 which is disposed in the engine block 106, is substantially within the centre of the circularly arranged cylinders 101-105. The location of the entire turbocharger 308 is more clearly illustrated in FIG. 3. Each cylinder 101-105 has a respective opening 111-115 for an injector body of the recirculation system of the present invention to be described below. Apertures 111*a*-115*a* are provided for spark plugs or other ignition related devices. The block also includes tie down bolt holes 116-120.

FIG. 2 shows the bottom plan view of the axial two-stroke engine 100. An air chest cover 320 has been removed to reveal a compression turbine 200 which forms part of the opposite end of the turbocharger 308. Formed between the compression turbine 200 and circularly arranged cylinders 101-105 is an air chest 201. The air chest 201 is linked to each cylinder 101-105 by way of transfer passages 202-206. Reed valves 207-211 which are disposed between each transfer passage 202-206 and the air chest 201, control the air flow between the air chest 201 and each transfer passage 202-206. The operation of the air chest 201, reed valves 207-211 and transfer passages 202-206 will be described in detail below.

The integral turbocharger 308 arrangement will now be described in more detail with reference to FIG. 3. FIG. 3 shows a section view of an engine block 106 with five evenly spaced cylinders 101-105 about an axis 305 of the engine block 106. The section has been taken through A-A shown in FIG. 1 and illustrates one 101 of the five cylinders 101-105.

Each cylinder 101-105 is substantially identical and therefore the description will refer to the visible cylinder 101 however it will be appreciated that the description will extend to all the cylinders 101-105 contained within the engine block 106. A piston 300 operates in a reciprocal motion within the cylinder 101. The cylinder 101 has associated with it an injector body 401 which forms part of one preferred recirculation system of the present invention.

Associated with the piston 300 is a connecting rod 302. A ball joint 303 disposed at one end of the connecting rod 302 is located in an associated socket 304 disposed in a bottom portion of the piston 300. The reciprocal motion of the piston 300 and connecting rod 302 arrangement in the engine block 106 is transferred to rotational motion of an output shaft by any power transmission means suitable for an axial motor, for example a wobble plate arrangement.

Within the engine block there is a chamber aligned substantially axially with the longitudinal axis 305 of the engine block 106. The chamber forms an intake duct 306 and an exhaust collector duct 307. The turbocharger 308 is located within the chamber. The turbocharger 308 is located within the engine block 106 substantially in alignmentwiththe axis 305 so that it is substantially parallel with the length of the cylinders 101-105. The turbocharger 308 includes a subassembly 309 which supports a rotatable turbine shaft 310, on one end of which is disposed the exhaust turbine 107 and on an opposite end is disposed the compression turbine or radial compressor 200.

Other features of the turbocharger are described in our PCT Publication No. WO 00/11330, the subject matter of which is incorporated herein by reference.

Disposed in the wall of the cylinder 101 are one or more exhaust ports 316 which are linked to the exhaust duct 307 via an exhaust passage 317. Also disposed in the wall of the cylinder 101 are one or more inlet ports 319 which are linked to the air chest 201 via the transfer passage 202 as shown in FIG. 2. Reed valves 207 disposed between the transfer passage 202 and inlets to the air chest 201 control the flow of air between the air chest 201 and the transfer passage 202. The air chest 201 has an air chest cover 320. A diffusor 321 is formed between the air chest cover 320 and turbocharger sub-assembly 309.

Operation of the engine will now be described with reference to cylinder 101, however it will be appreciated that each cylinder is substantially identical and therefore any description with regard to the cylinder 101 should be considered to extend to the remaining cylinders.

The turbocharger is driven by exhaust gases 327 which are expelled from the cylinder 101. During the exhaust phase of the engine cycle, the piston 300 travels downwards within the cylinder 101 and exposes one or more exhaust ports 316 disposed in the cylinder 101 wall. The exhaust gases 327 from the combustion cycle are expelled from cylinder 101 through the one or more exhaust ports 316. The exhaust gases 327 pass through the exhaust passage 317, where the exhaust gases 327 pass through the stator 313 which guides the exhaust gases 327 directly onto the exhaust turbine 107. Once the exhaust gases 327 have impacted on the exhaust turbine 107 they pass through to the exhaust duct 307.

The rotation of the exhaust turbine 107 rotates the turbine shaft 310 and thus drives the compression turbine 200. The rotating compression turbine 200 draws air 328 through the intake duct 306 and passes the compressed air 328 through the diffusor 321 into the air chest 201. As the piston 300 rises the differential pressure opens the reed valves 207 and enables the air 328 from the air chest 201 to transfer to the volume 326 underneath the piston 300. During the air transfer portion of the combustion cycle, the piston 300 travels downwards within the cylinder 101 which pressurises the air 328 underneath the piston, thus closing the reed valves 207. As the piston 300 travels further the inlet ports 319 disposed in the wall of the cylinder 101 are exposed. The compressed air 328 in the volume 326 underneath the piston 300 is then transferred through the transfer passage 202-206 and the one or more inlet ports 319 into the cylinder 101.

In a further embodiment the engine includes a coolant jacket 322. The jacket 322 is formed by a combination of the turbocharger sub-assembly 309, inwardly protruding surfaces 314, 315 and engine block 106. The normal coolant used is water which can be fed into the coolant jacket 322 via a coolant entry port 323. The coolant circulates through the jacket 322 to enable heat dissipation from the turbocharger 308. The turbocharger sub-assembly 309 in combination with the mass of metal comprising the inwardly protruding surfaces 314, 315 and engine block 106 provides a sufficient heat sink to enable circulating coolant to dissipate heat from the turbocharger 308 upon cessation of the engine 100 operation. The dissipation of heat from the turbocharger 308 in this manner will minimise the likelihood of carbonisation of lubricant used within the turbocharger 308.

In a further embodiment a water cooling jacket may surround the external portion 400 of exhaust duct 307 to provide cooling for turbine shaft 310 and bearing 503.

Figure 4:
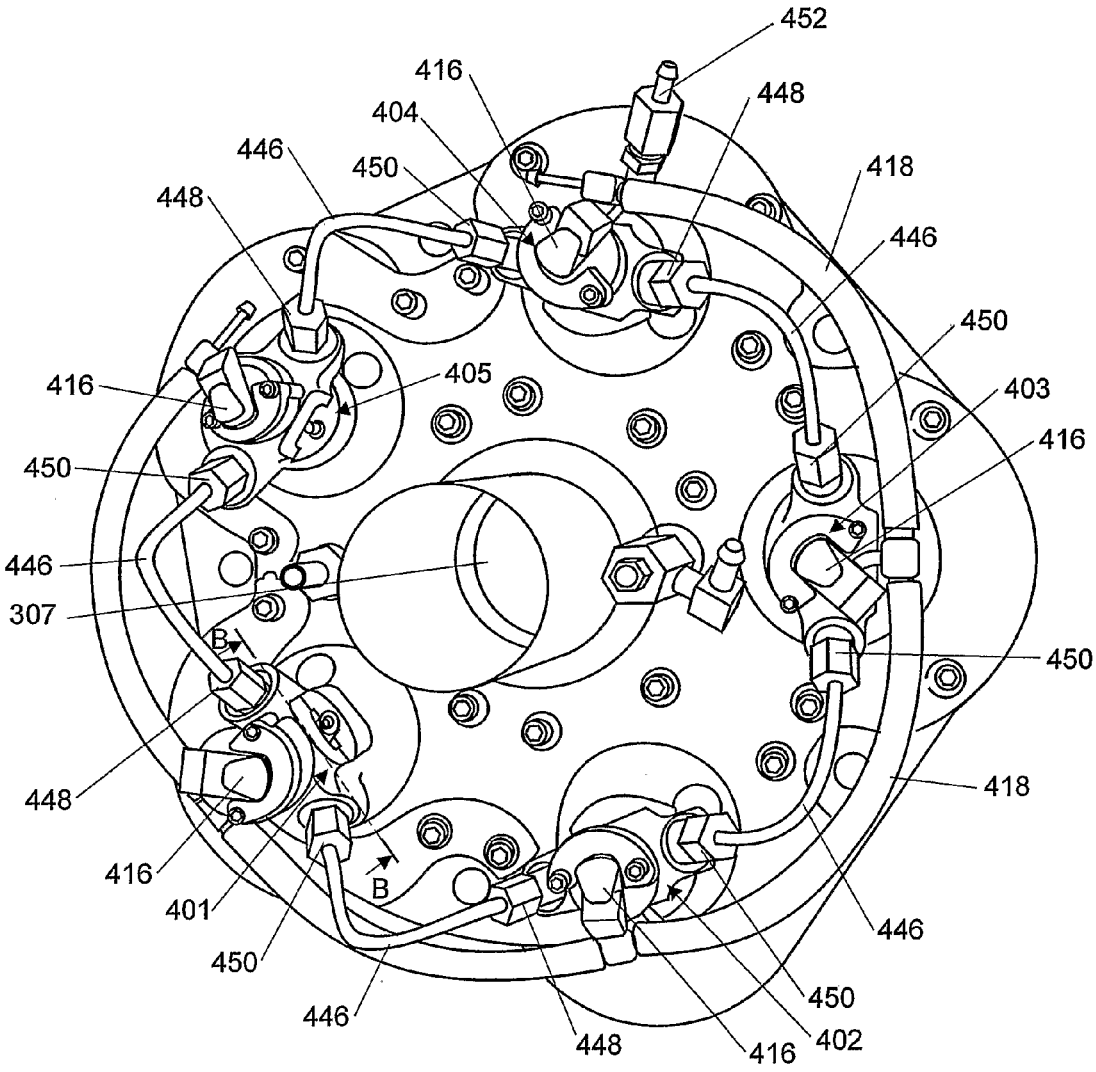
FIG. 4 is a plan view of the recirculation system in accordance with a first preferred embodiment of the present invention.
Figure 5:
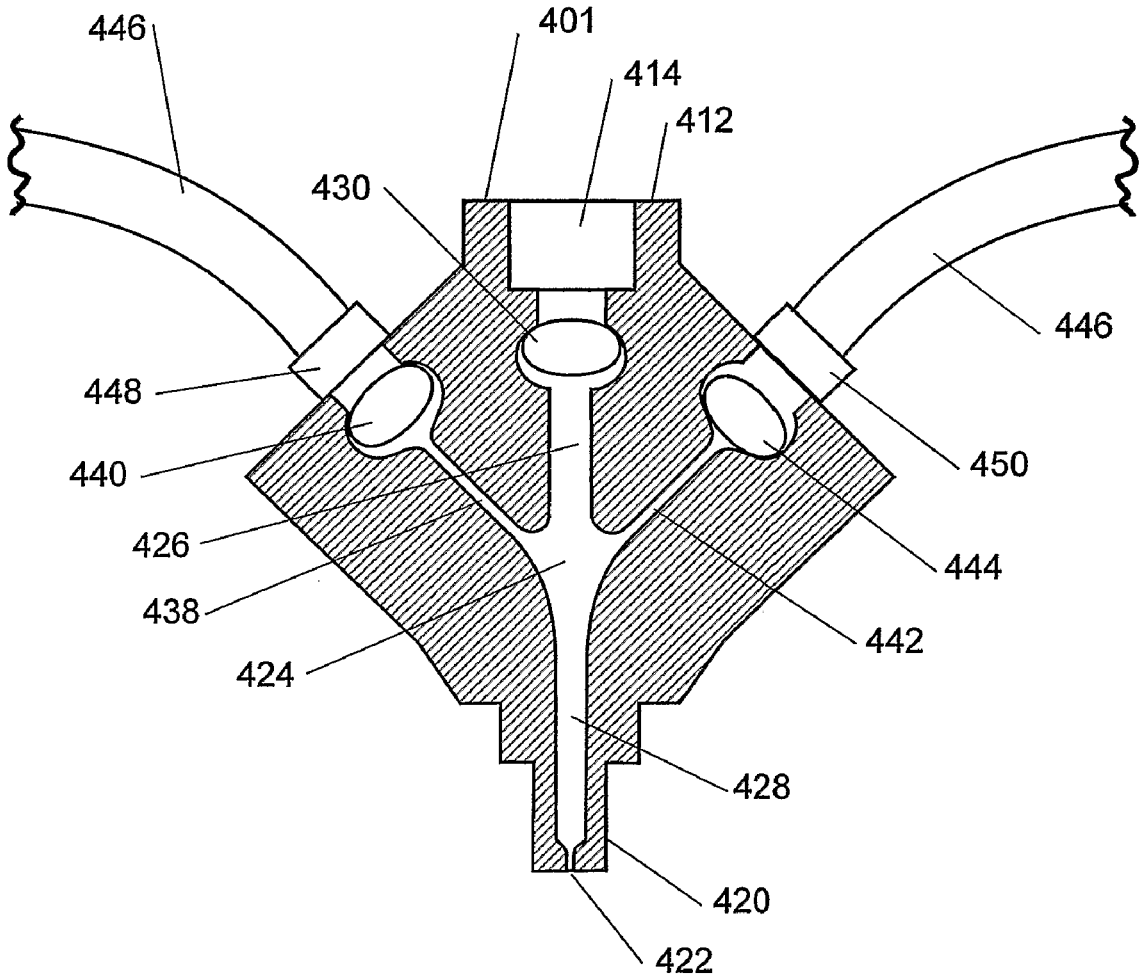
FIG. 5 is a section through an injector body along line B-B of FIG. 4.

The axial motor is configured with a recirculation system in accordance with a first preferred embodiment of the present invention, which has a layout shown more clearly in FIG. 4. The preferred recirculation system is in the form of a fuel injection system which includes a plurality of injector bodies 401-405, each of which is mounted in an opening 111-115 associated with a respective cylinder 101-105. The injector bodies are configured to deliver gas to, and receive gas from, the cylinders. A cross section through one of the injector bodies 401 is shown in FIG. 5. While only one injector body is shown, it should be appreciated that the other injector bodies will generally have the same features. An upper part of the injector body 401 is configured for connection to a source of fuel, and in the embodiment shown includes an aperture 414 into which a fuel injector 416 such as shown in FIG. 4 is inserted. Each of the fuel injectors 416 is connected to a tube or pipe 418 which will generally be in fluid communication with a fuel source and fuel pump (not shown). The fuel injectors 416 may be conventional electromagnetic solenoid valve injectors.

The lower part of the injector body includes a fuel outlet port 428 and a nozzle 420 for delivering fuel into an associated cylinder. The nozzle 420 preferably includes a restriction orifice 422 to deliver fuel under pressure into the cylinder. The typical delivery pressure may be in the order of 90 psi (about 621 kPa). The aperture 414 and restriction orifice 422 are in fluid communication with an internal chamber 424 in the injector body via a fuel inlet port 426 and a fuel outlet port 428 respectively. A non-return valve 430 is provided in the fuel inlet port 426 to allow fuel to be delivered into the internal chamber 424 through the fuel inlet port 426 and to prevent fuel from travelling out through the fuel inlet port 426. The non-return valve 430 is preferably in the form of a ball valve.

The housing also includes a mixture inlet port 438 which extends into the housing and provides for the delivery of air/fuel mixture to the internal chamber 424. Again, the mixture inlet port includes a non-return valve 440 which may be of the type described above, and which allows mixture to travel into the internal chamber 424 through the mixture inlet port but which also prevents mixture from exiting the housing from the internal chamber 424 via the mixture inlet port.

A mixture outlet port 442 is also provided in the housing which allows mixture to travel out of the internal chamber 424. Again, the mixture outlet port preferably includes a non-return valve 444 which may be of the type described above, and which allows mixture to travel out of the housing from the internal chamber 424, but which prevents mixture from travelling back into the internal chamber through the mixture outlet port 442. The fuel inlet port 426, fuel outlet port 428, mixture inlet port 438 and mixture outlet port 442 are all in fluid communication with the internal chamber 424. The mixture outlet port 442 is preferably of narrower diameter than the fuel outlet port 428, so there is greater resistance to fuel travel through the mixture outlet port 442 than through the fuel outlet port 428. In the preferred embodiment, the fuel outlet port 428 and restriction orifice 422 are less restrictive than any other entry into or exit out of the injector body.

In some circumstances, it may be desirable to have only a single non-return valve between adjacent injector bodies. One of the non-return valves could be excluded and instead the port could pass directly through. In a particularly preferred alternative embodiment, one of the non-return valves 440, 444 shown in the figures (and preferably the mixture outlet port non-return valve 444) could be replaced with a spacer having an aperture extending therethrough. The aperture will substantially align with the port to enable mixture to flow through the port. Preferably, the spacer is adjustable or removable and replaceable with a spacer having an aperture of a different size, to "tune" the port for different fuels.

While the preferred internal chamber 424 is shown as a somewhat enlarged region within the injector body, that is not necessary and the chamber could instead simply be defined by a junction between the mixture inlet port, mixture outlet port, fuel inlet port and fuel outlet port.

Reverting to FIG. 4, a transfer path which in the embodiment shown is provided by a pipe, tube or the like 446 is connected between the mixture outlet port 442 of each injector body and the mixture inlet port of an injector body associated with the next cylinder in the firing order. More particularly, a connector 448 on one end of each pipe 446 is connected to the mixture inlet port of a respective injector body, and a connector 450 on the other end of each pipe 446 is connected to the mixture outlet port of the injector body associated with the immediately preceding cylinder in the firing order. By this manner, the injector bodies are connected in a sequential manner around the engine block, which sequence corresponds to the firing order of the motor.

As will be described in more detail with reference to FIG. 6, during operation of the motor combusted mixture is delivered under combustion temperature and pressure via the pipes 446, mixture outlet ports 442 and mixture inlet ports 438 to adjacent injector bodies associated with the following cylinders in the firing order, to improve combustion properties for the adjacent cylinders.

FIG. 4 also shows an air-start valve 452 which is connectable to a source of air for starting the engine. It has been found that it is possible to start the present system using a relatively heavy fuel such as diesel at ambient temperature without additional heating. During cranking of the engine via the air start, the pressurised air from the air start forces the mixture through the recirculation system in substantially the same way as occurs during normal operation of the engine (as described below), however the mixture will not be at such an elevated temperature.

In FIG. 6, three cylinders 101, 102, 105 of the engine are shown. As mentioned above, each cylinder has a respective fuel injector body 401, 402, 405 with a mixture inlet port 438 and mixture outlet port 442. The mixture outlet port 442 of each injector body is connected to the mixture inlet port 438 of a neighbouring injector body by a pipe 446. It will be appreciated that the mixture outlet port 442 of injector body 402 will be in fluid communication with the mixture inlet port 438 of injector body 403, and the mixture outlet port 442 of injector body 404 will be in fluid communication with the mixture inlet port 438 of injector body 405.

The motor is configured such that the cylinders fire sequentially around the motor. As this embodiment of axial motor has five cylinders, the pistons will be sequentially operating 72 degrees behind one another.

Figure 6A:
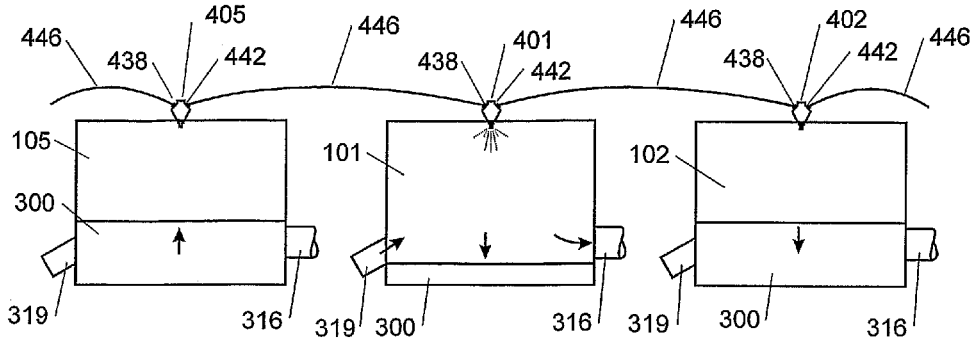
FIGS. 6*a*, 6*b*, and 6*c* are schematic diagrams showing the sequence of operation of the recirculation system of a preferred embodiment of the present invention between three cylinders.

In the position shown in FIG. 6*a*, the piston 300 in cylinder 101 is moving downwards towards bottom dead centre, and the injector body 401 is delivering fuel into the cylinder. Generally speaking, in the preferred embodiment fuel injection would start when the piston is about 19 degrees before bottom dead centre, but it will be appreciated that that would be variable to obtain the desired firing properties. As the exhaust port 316 is open a vacuum is created above the piston, which assists in drawing fuel in from the injector body 401. The downward movement is also forcing pressurised air into the upper part of the cylinder from the volume below the cylinder via the inlet ports 319, as described above with reference to FIG. 3. That air is effectively supercharged, due to the pressure provided by the piston movement. The fuel from the injector body is mixed with the air which has entered the upper part of the cylinder from the inlet ports 319.

Meanwhile, the piston 300 in cylinder 105 is on its compression stroke, and the inlet and exhaust ports of that cylinder are closed. The compression movement applies pressure to the uncombusted air/fuel mixture in the region above the piston 300 which drives some air/fuel mixture into the internal chamber 424 in the injector body 405. Due to the non-return valve 440 in the mixture inlet port 438 of injector body 405 preventing mixture from exiting via the mixture inlet port 438, as well as the non-return valve 430 preventing mixture from exiting via the fuel inlet port, the mixture is forced under relatively low pressure through the mixture outlet port 442 of the injector body 405 and pipe 446 into the mixture inlet port 438 of the injector body 401 associated with cylinder 101. The pressure in the air/fuel mixture being transferred is greater than the pressure in the upper part of the cylinder 101 at the time, which enables the transfer to take place. Some of the transferred uncombusted mixture will remain in the pipe 446.

The piston 300 in cylinder 102 meanwhile, is on its power stroke, about 72 degrees behind the piston in cylinder 101. Due to the pressure in cylinder 102 being greater than in cylinder 101 and the configuration of the non-return valves in the ports, the mixture from cylinder 105 will be prevented from travelling beyond cylinder 101 to cylinder 102.

Figure 6B:
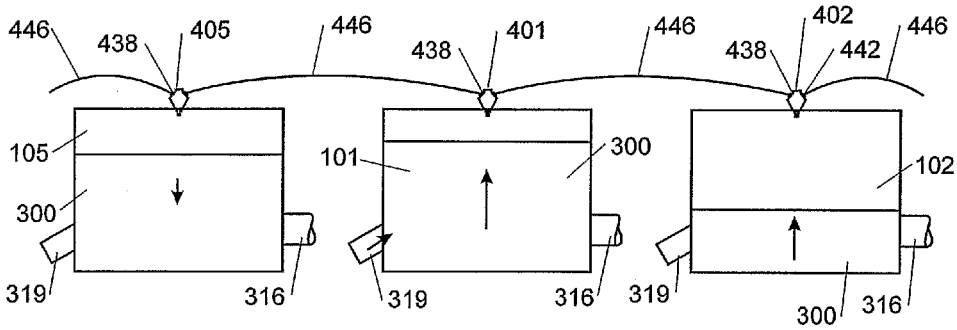

Referring now to FIG. 6*b*, the piston in cylinder 101 is nearing the top of its compression stroke, the piston in cylinder 102 is earlier in its compression stroke, and the piston in cylinder 105 is on its power stroke just after combustion. The high pressure in cylinder 105 forces combusted mixture back up into injector body 405, and that is delivered to the neighbouring injector body 401 under combustion temperature and pressure, where it mixes with fuel. As can be seen in FIG. 5, due to the fuel outlet port 428 being less restrictive than the mixture outlet port, the majority of the mixture will travel to cylinder 101 rather than 102. Also, the time factor also prevents a large amount of the combusted mixture travelling to cylinder 102 at this stage of the process. The combusted mixture also forces any remaining residual uncombusted mixture from the compression stroke in the pipe to the injector body associated with cylinder 101. Meanwhile, the upwards movement of the piston in cylinder 101 forces air/fuel mixture under relatively low pressure into cylinder 102.

Figure 6C:
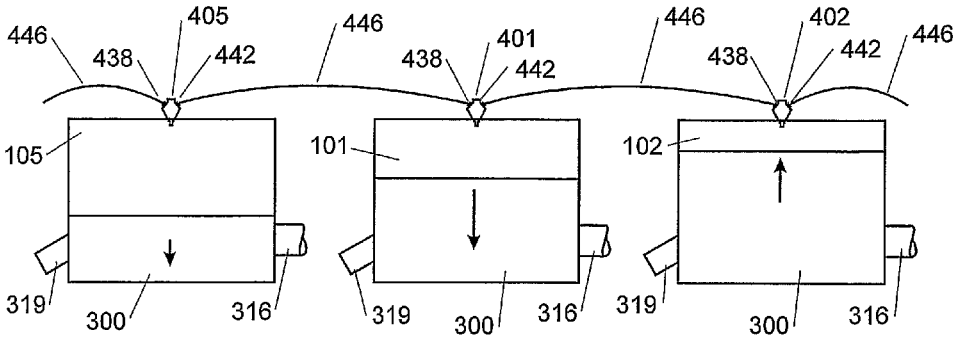

Referring now to FIG. 6*c*, cylinder 101 has just undergone combustion (which occurs just before top dead centre), and its piston 300 is on the power stroke. The piston in cylinder 102 meanwhile is nearing the top of its compression stroke, and the piston in cylinder 105 is further through its power stroke. Following combustion of the mixture in the cylinder 101, combusted mixture under combustion pressure and temperature is delivered to the injector body 402 associated with cylinder 102, and will mix with the fuel in that injector 402 prior to combustion. Meanwhile, relatively low pressure air/fuel mixture will be delivered from injector body 402 to the injector body 403 associated with cylinder 103 due to the compression movement of the piston in cylinder 102.

Typical combustion pressures which may occur in an axial motor of this type are in the order of about 600 psi to about 100 psi (about 4137 KPa to about 6895 KPa).

Meanwhile, there will be higher pressure in cylinder 105 than in cylinder 104 due to relatively recent combustion in cylinder 105; therefore no mixture will be delivered from cylinder 104 to cylinder 105 in the position shown in FIG. 6*c*.

It will be appreciated that while only three cylinders are shown here, the procedure will continue in a sequential manner around the engine block. The same amount of fuel can be delivered to each injector body by the injectors, but the system will equalise the delivery of mixture and fuel as necessary around the engine.

It will be appreciated from the above description that a stratified combusted mixture is transferred under high pressure and temperature, along with some residual uncombusted mixture, to a neighbouring injector body and mixed with a combustible mixture under compression pressure as that cylinder nears its firing position, to assist in atomising and distributing that combustible mixture in the cylinder.

It has also been found that during combustion in a cylinder, if piston rings are not used, then part of the combusted charge will travel down the sides of the piston. This assists in reducing the friction associated with piston movement, which is particularly useful if non-metallic pistons such as carbon pistons are to be used for example. The amount of combusted mixture being transferred to an adjacent cylinder is dependent on the combustion pressure, which is a product of the amount of fuel delivered into the cylinder prior to combustion. Therefore, the properties can be adjusted by altering the amount of fuel delivered to each cylinder by the respective injector and injector body. Further, the lengths of the pipes or tubes 446 can be adjusted to "tune" the properties of the fuel injection system. If longer pipes or tubes 446 are used there will be greater delay in delivery of the combusted mixture to the adjacent injector body, whereas if shorter pipes or tubes are used there will be less delay in delivery of the combusted mixture to the adjacent injector body.

By delivering combusted mixture under combustion temperature and pressure from one cylinder to a following cylinder, the combustion properties have been found to improve. The combusted mixture slows the flame travel and retards ignition in the following cylinder in the firing order. That enables higher compression ratios to be used with heavy fuels such as diesel hydrocarbon fuel, with reduced "knocking" or auto-ignition. Further, the elevated temperature and pressure of the combusted mixture picks up fuel in the adjacent injector body and atomises the fuel prior to its delivery into the cylinder, again improving combustion properties for that cylinder. This is particularly useful when using heavy fuels such as diesel. However, the preferred embodiment systems are also useful with light fuels such as petrol.

For example, with an axial motor having a configuration shown in FIGS. 1 to 3 and including a preferred embodiment recirculation system, the maximum compression ratio (the volume of the cylinder above the piston at bottom-dead-centre divided by the volume of the cylinder above the piston at top-dead-centre) at which useful combustion of diesel could occur was about 8:1. At higher compression ratios, the piston was burning out due to detonation/auto-ignition. With a system incorporating a preferred embodiment recirculation system, it has been found that useful combustion of diesel can occur at compression ratios of between 9:1 and 10:1 without any significant detonation, and it may be possible to achieve compression ratios of up to 10.5:1-11:1. Generally, improved engine performance is achieved with a higher compression ratio, provided there is not excessive detonation.

The above describes a preferred embodiment of the present invention, and modifications may be made thereto without departing from the scope of the invention. For example, while the motor is described as being a two-stroke axial motor, it could alternatively be a four-stroke axial motor. In that case, air/fuel mixture would be delivered from a cylinder to an adjacent cylinder under relatively low pressure during the compression stroke, and under higher pressure immediately following combustion.

Further, the motor may be an in-line, vee, or horizontally opposed ("boxer") configuration two- or four-stroke internal combustion motor, or a rotary engine.

It will be appreciated that the recirculation system need not be used in conjunction with an internal turbocharger, and it will work successfully with a normally aspirated engine. Further, the fuel injection system could be used in an axial motor having opposed pistons, such as that described in our PCT publication number WO 03/010417. It will be appreciated that if a fuel injection system is used with both banks of pistons in the opposed piston motor, the configuration of valves between the injectors in one bank will be the opposite to the other bank, so that overall the sequence of operation will be in the same direction for both banks.

Rather than using the inlet ports 319 and exhaust ports 316 as shown, the engine could have conventional intake and exhaust valves for each cylinder.

Rather than providing the interconnection between injector bodies for transfer of combusted mixture, the transfer could occur substantially within the cylinder head of the motor. For example, the part of the cylinder head associated with the tops of each cylinder could have ports at or adjacent the tops of the cylinders. These ports could be interconnected via internal transfer paths such as internal channels. In one embodiment, a pre-mix chamber is provided at the top of each cylinder, and the motor includes transfer paths such as internal channels which are configured to deliver combusted mixture under combustion temperature and pressure from the pre-mix chamber associated with a cylinder that has just fired to the pre-mix chamber associated with the next cylinder in the firing order. Each pre-mix chamber may have a mixture inlet port, a mixture outlet port, an aperture or port for receipt of fuel from a fuel injector, and a fluid path into the cylinder which preferably includes a nozzle or restriction to deliver mixture for combustion into the respective cylinder under pressure. The spark plug(s) associated with each cylinder are preferably present in the cylinder itself rather than in the pre-mix chamber, so that the combustion occurs in the cylinder and then forces combusted mixture back up into the pre-mix chamber and to the pre-mix chamber associated with the next cylinder in the firing order via the transfer path. The operation will generally be the same as described above.

Figure 7:
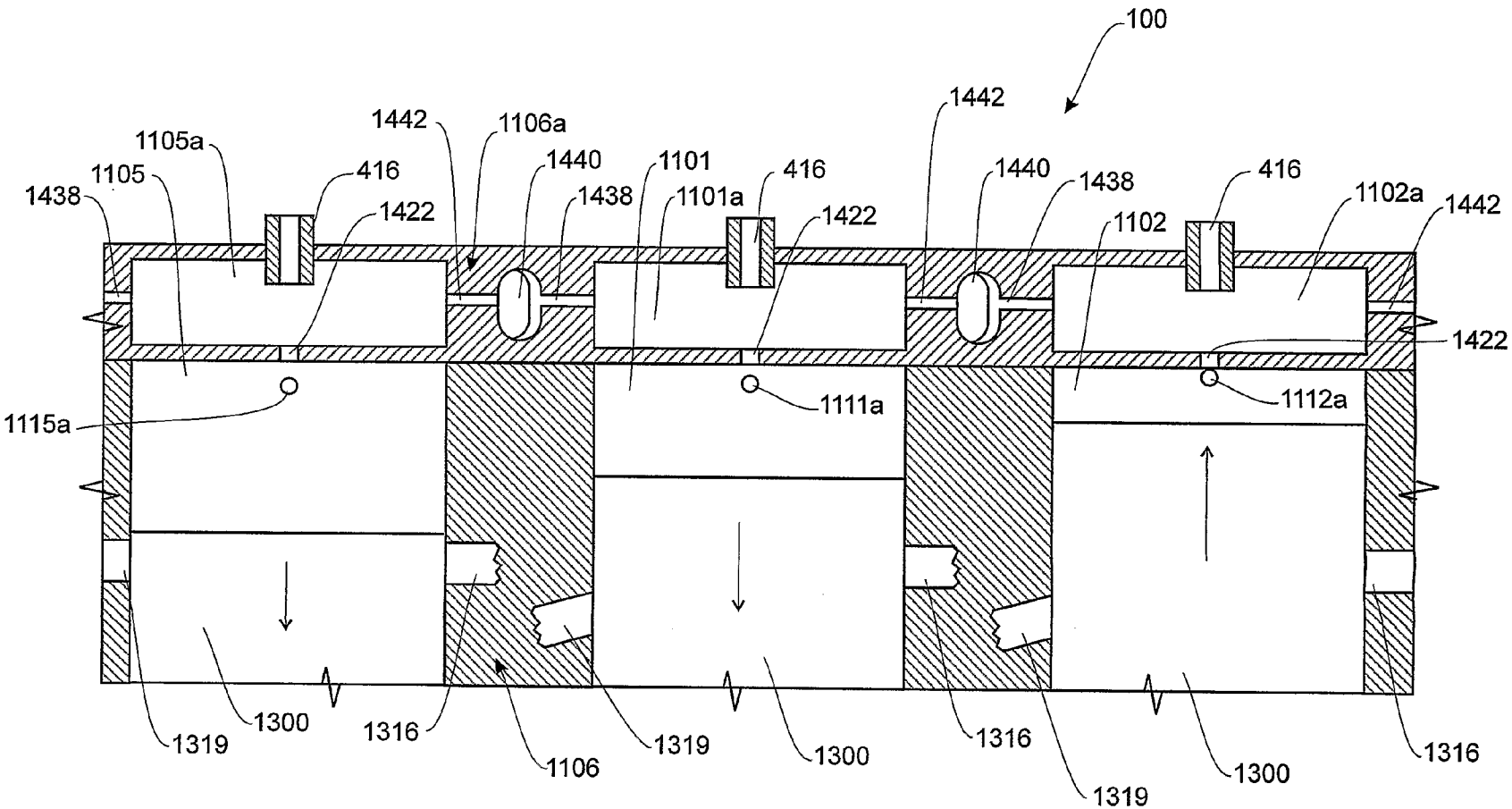
FIG. 7 is a schematic sectional view of part of an engine having a recirculation system in accordance with a second preferred embodiment of the present invention.

Such a system is shown schematically in FIG. 7. Unless described otherwise, the functioning and features in the system of FIG. 7 should be considered to be the same as in the systems described above, and like reference numerals are used to indicate like parts, with the addition of 1000.

FIG. 7 shows three cylinders 1105, 1101, 1102 of a preferred embodiment engine 1100. The cylinders are located in an engine block 1106. A piston 1300 is reciprocably mounted in each cylinder. A cylinder head 106*a* is mounted to the engine block, and in the embodiment shown has a pre-mix chamber 1105*a*, 1101*a*, 1102*a* associated with each cylinder. A fuel injector 416 is mounted in an aperture in the top of each pre-mix chamber 1105*a*, 1101*a*, 1102*a*. Each pre-mix chamber has a mixture inlet port 1438 and a mixture outlet port 1442. A non-return valve 1440 is positioned between the mixture outlet port 1442 of each one of the pre-mix chambers and the mixture inlet port of the pre-mix chamber associated with the following cylinder in the firing order. An aperture or nozzle 1422 provides fluid communication between each cylinder and its respective pre-mix chamber. Within each cylinder, an aperture 1111*a*, 1112*a*, 1113*a*, 1114*a* is provided for receipt of a spark plug (not shown), and is preferably in the vicinity of the respective aperture or nozzle 1422. If necessary, a non-return valve can be provided between each fuel injector 416 and its respective pre-mix chamber to prevent combusted mixture from entering the fuel injector.

In use, combusted mixture from a cylinder which has just fired is forced back up into the pre-mix chamber associated with that cylinder. Due to the configurations of the non-return valves 1440, the combusted mixture exits that pre-mix chamber via the mixture outlet port and enters the pre-mix chamber associated with the next cylinder in the firing order. That combusted mixture mixes with and atomises fuel from the fuel injector 416 and enters the cylinder which is about to fire. That mixture is then combusted by the spark plug, and combusted mixture is forced back up into the pre-mix chamber and delivered to the following pre-mix chamber in the same manner described above. That process will continue around the cylinders of the engine in the firing order. While three cylinders are shown, it will be appreciated that the engine may have more cylinders.

It is preferred that the injector bodies and external transfer paths are used, as they can more be easily dismantled for cleaning.

The invention claimed is:

1. A motor comprising: an engine block with three or more cylinders arranged to fire with a firing order; a fuel injector associated with each cylinder; and a recirculation system comprising fluid transfer paths which are arranged to provide a fluid connection between cylinders sequentially in the firing order of the motor, the motor configured such that combustion in a cylinder creates a combusted mixture having a combustion pressure, which combustion pressure forces some of that combusted mixture to at least partly mix with fuel for the next cylinder in the firing order to improve the combustion properties of the fuel, and to deliver a mixture of the combusted mixture and fuel under elevated temperature and pressure into said next cylinder in the firing order.

2. A motor comprising: an engine block with three or more cylinders arranged to fire with a firing order; a fuel injector associated with each cylinder; and a recirculation system comprising fluid transfer paths which are arranged to provide a fluid connection between cylinders sequentially in the firing order of the motor, the motor configured such that combustion in a cylinder creates a combusted mixture having a combustion pressure, which combustion pressure forces some of that combusted mixture to at least partly mix with fuel for the next cylinder in the firing order to improve the combustion properties of the fuel, and to deliver a mixture of the combusted mixture and fuel under elevated temperature and pressure into said next cylinder in the firing order, wherein each cylinder has an injector body associated therewith, with each injector body having an internal chamber in communication with a fuel inlet port for delivering fuel into the internal chamber, a fuel outlet port for delivering fuel under pressure from the chamber into the associated cylinder, a mixture inlet port and a mixture outlet port, with the mixture inlet port of each injector body in fluid communication with the mixture outlet port of an injector body associated with the immediately preceding cylinder in the firing order of the motor, the motor configured to deliver combusted mixture under combustion pressure and temperature from an outlet port of an injector body associated with a cylinder that has just fired to an inlet port of an injector body associated with the next cylinder in the firing order of the motor to at least partly mix with fuel in the internal chamber of the injector body associated with said next cylinder in the firing order to improve the combustion properties of the fuel.

3. A motor as claimed in claim 2, wherein the fuel inlet port of each injector body is configured for receipt of a respective fuel injector.

4. A motor as claimed in claim 2, wherein each mixture inlet port comprises a non-return valve which allows the mixture to travel into the internal chamber through the port but not out of the internal chamber through the port.

5. A motor as claimed in claim 2, wherein each mixture outlet port comprises a non-return valve which allows mixture to travel out of the internal chamber through the port but not into the internal chamber through the port.

6. A motor as claimed in claim 2, wherein each fuel inlet port comprises a non-return valve which allows fuel to flow into the internal chamber through the fuel inlet port, but not out of the internal chamber through the fuel inlet port.

7. A motor as claimed in claim 2, wherein transfer paths are provided to fluidly connect the mixture inlet port of each injector body with the mixture outlet port of the injector body associated with the immediately preceding cylinder in the firing order.

8. A motor as claimed in claim 7, wherein the transfer paths comprise pipes or tubes.

9. A motor as claimed in claim 1, wherein the motor is an axial motor.

10. A motor comprising: an engine block with three or more cylinders arranged to fire with a firing order; a fuel injector associated with each cylinder; and a recirculation system comprising fluid transfer paths which are arranged to provide a fluid connection between cylinders sequentially in the firing order of the motor, the motor configured such that combustion in a cylinder creates a combusted mixture having a combustion pressure, which combustion pressure forces some of that combusted mixture to at least partly mix with fuel for the next cylinder in the firing order to improve the combustion properties of the fuel, and to deliver a mixture of the combusted mixture and fuel under elevated temperature and pressure into said next cylinder in the firing order, wherein the recirculation system is arranged substantially internally within a cylinder head of the motor.

11. A motor as claimed in claim 10, wherein the cylinder head comprises a pre-mix chamber associated with each cylinder, and the cylinder head includes transfer paths configured to deliver combusted mixture under combustion pressure and temperature from the pre-mix chamber associated with a cylinder that has just fired to the pre-mix chamber associated with the next cylinder in the firing order.

12. A motor as claimed in claim 11, wherein each transfer path comprises at least one non-return valve configured to allow combusted mixture under combustion pressure and temperature to be delivered to the pre-mix chamber associated with the next cylinder in the firing order.

13. A motor as claimed in claim 11, wherein a fluid path is provided between each pre-mix chamber and the respective cylinder.

14. A motor as claimed in claim 13 wherein each fluid path comprises a nozzle to deliver mixture for combustion into the respective cylinder under pressure.

15. A motor comprising: an engine block with three or more cylinders arranged to fire with a firing order; a fuel injector associated with each cylinder; and a recirculation system comprising fluid transfer paths which are arranged to provide a fluid connection between cylinders sequentially in the firing order of the motor, the motor configured such that combustion in a cylinder creates a combusted mixture having a combustion pressure, which combustion pressure forces some of that combusted mixture to at least partly mix with fuel for the next cylinder in the firing order to improve the combustion properties of the fuel, and to deliver a mixture of the combusted mixture and fuel under elevated temperature and pressure into said next cylinder in the firing order, wherein the motor is configured to operate in a two-stroke configuration and wherein the motor is configured such that the combusted mixture is delivered to at least partly mix with the fuel for the next cylinder in the firing order as the piston in said next cylinder is nearing the top of its compression stroke.

16. A motor as claimed in claim 15, wherein the motor is configured such that when a cylinder is on its compression stroke, some uncombusted air/fuel mixture is delivered under relatively low pressure to the next cylinder in the firing order said next cylinder is undergoing its compression stroke.

17. A motor comprising: an engine block with three or more cylinders arranged to fire with a firing order; a fuel injector associated with each cylinder; and a recirculation system comprising fluid transfer paths which are arranged to provide a fluid connection between cylinders sequentially in the firing order of the motor, the motor configured such that combustion in a cylinder creates a combusted mixture having a combustion pressure, which combustion pressure forces some of that combusted mixture to at least partly mix with fuel for the next cylinder in the firing order to improve the combustion properties of the fuel, and to deliver a mixture of the combusted mixture and fuel under elevated temperature and pressure into said next cylinder in the firing order, wherein the motor is configured to deliver some uncombusted mixture from a cylinder as its piston is undergoing a compression stroke to a fluid transfer path which provides a fluid connection between that cylinder and the following cylinder in the firing order, such that when combustion occurs in the cylinder, the combusted mixture from that cylinder forces the uncombusted mixture from the transfer path to mix with fuel for the next cylinder in the firing order.

18. A recirculation system for a motor having three or more cylinders arranged to fire with a firing order, comprising: a plurality of fuel injector bodies, each injector body having an internal chamber in communication with a fuel inlet port for delivering fuel into the internal chamber, a fuel outlet port for delivering fuel under pressure into an associated cylinder, a mixture inlet port and a mixture outlet port, and arranged with the mixture inlet port of each injector body in fluid communication with the mixture outlet port of an injector body associated with the immediately preceding cylinder in the firing order of the motor; the recirculation system configured to deliver combusted mixture from an outlet port of an injector body associated with a cylinder that has just fired to an inlet port of the injector body associated with the next cylinder in the firing order to at least partly mix with fuel in the internal chamber of that next injector body to improve the combustion properties of the fuel, and to deliver a mixture of the combusted mixture and fuel under elevated temperature and pressure from the fuel outlet port of said injector body associated with the next cylinder in the firing order.

19. A recirculation system as claimed in claim 18, wherein the fuel inlet port of each injector body is configured for receipt of a respective fuel injector.

20. A recirculation system as claimed in claim 18, wherein each mixture inlet port comprises a non-return valve which allows the mixture to travel into the internal chamber through the port but not out of the internal chamber through the port.

21. A recirculation system as claimed in claim 18, wherein each mixture outlet port comprises a non-return valve which allows mixture to travel out of the internal chamber through the port but not into the internal chamber through the port.

22. A recirculation system as claimed in claim 18, wherein each fuel inlet port comprises a non-return valve which allows fuel to flow into the internal chamber through the fuel inlet port, but not out of the internal chamber through the fuel inlet port.

23. A recirculation system as claimed in claim 18, wherein the mixture outlet port of each injector body is fluidly connected to the mixture inlet port of the injector body associated with the next cylinder in the firing order of the motor by a transfer path.

24. A recirculation system as claimed in claim 23, wherein each transfer path comprises a pipe or tube.

25. A recirculation system as claimed in claim 18, configured such that the combusted mixture at least partly atomises the fuel in the internal chamber to which the combusted mixture has been delivered under combustion pressure and temperature.

26. A method of enhancing combustion in a motor having an engine block with at least three cylinders arranged to fire with a firing order, and a fuel injector associated with each cylinder, comprising delivering a combusted mixture under combustion pressure and temperature from a cylinder which has just fired to at least partly mix with fuel for the next cylinder in the firing order to improve the combustion properties of the fuel, and delivering a mixture of the combusted mixture and fuel under elevated temperature and pressure into said next cylinder in the firing order.

27. A method of enhancing combustion in a motor having an engine block with at least three cylinders arranged to fire with a firing order, and a fuel injector associated with each cylinder, comprising delivering a combusted mixture under combustion pressure and temperature from a cylinder which has just fired to at least partly mix with fuel for the next cylinder in the firing order to improve the combustion properties of the fuel, and delivering a mixture of the combusted mixture and fuel under elevated temperature and pressure into said next cylinder in the firing order, wherein each cylinder has an injector body associated therewith, with each injector body having an internal chamber in communication with a fuel inlet port for delivering fuel into the internal chamber, a fuel outlet port for delivering fuel under pressure from the chamber into the associated cylinder, a mixture inlet port and a mixture outlet port, with the mixture inlet port of each injector body in fluid communication with the mixture outlet port of an injector body associated with the immediately preceding cylinder in the firing order of the motor; and wherein the method comprises delivering combusted mixture under combustion pressure and temperature from an outlet port of an injector body associated with a cylinder that has just fired to an inlet port of an injector body associated with the next cylinder in the firing order of the motor to at least partly mix with fuel in the internal chamber of that adjacent injector to improve the combustion properties of the fuel.

28. A method as claimed in claim 27, wherein transfer paths are provided to link the mixture outlet port of each injector body with the mixture inlet port of the injector body associated with the next cylinder in the firing order and the step of delivering combusted mixture under combustion pressure and temperature from an outlet port of an injector body associated with a cylinder that has just fired to an inlet port of an injector body associated with the next cylinder in the firing order of the motor, comprises transferring the combusted mixture via the respective transfer path.

29. A method of enhancing combustion in a motor having an engine block with at least three cylinders arranged to fire with a firing order, and a fuel injector associated with each cylinder, comprising delivering a combusted mixture under combustion pressure and temperature from a cylinder which has just fired to at least partly mix with fuel for the next cylinder in the firing order to improve the combustion properties of the fuel, and delivering a mixture of the combusted mixture and fuel under elevated temperature and pressure into said next cylinder in the firing order, wherein the step of delivering the combusted mixture under combustion pressure and temperature to at least partly mix with fuel for the next cylinder in the firing order occurs internally within a cylinder head of the motor.

30. A method as claimed in claim 29, wherein a pre-mix chamber is associated with each cylinder, and the method comprises delivering combusted mixture under combustion pressure and temperature from the pre-mix chamber associated with a cylinder that has just fired to the pre-mix chamber associated with the next cylinder in the firing order.

31. A method as claimed in claim 30, comprising delivering mixture for combustion from each pre-mix chamber into the respective cylinder under pressure.

32. A method of enhancing combustion in a motor having an engine block with at least three cylinders arranged to fire with a firing order, and a fuel injector associated with each cylinder, comprising delivering a combusted mixture under combustion pressure and temperature from a cylinder which has just fired to at least partly mix with fuel for the next cylinder in the firing order to improve the combustion properties of the fuel, and delivering a mixture of the combusted mixture and fuel under elevated temperature and pressure into said next cylinder in the firing order, wherein the motor is configured to operate in a two-stroke configuration, and the step of delivering combusted mixture under combustion pressure and temperature from a cylinder which has just fired to at least partly mix with fuel for the next cylinder in the firing order occurs as the piston in said next cylinder is nearing the top of its compression stroke.

33. A method as claimed in claim 32, comprising delivering from a cylinder on its compression stroke some uncombusted air/fuel mixture under relatively low pressure to the next cylinder in the firing order as said next cylinder is undergoing its compression stroke.

34. A method of enhancing combustion in a motor having an engine block with at least three cylinders arranged to fire with a firing order, and a fuel injector associated with each cylinder, comprising delivering a combusted mixture under combustion pressure and temperature from a cylinder which has just fired to at least partly mix with fuel for the next cylinder in the firing order to improve the combustion properties of the fuel, and delivering a mixture of the combusted mixture and fuel under elevated temperature and pressure into said next cylinder in the firing order, the method further comprising delivering some uncombusted mixture from a cylinder as its piston is undergoing a compression stroke to a fluid transfer path, which provides a fluid connection between that cylinder and the following cylinder in the firing order, such that when combustion occurs in the cylinder the combusted mixture from that cylinder forces the uncombusted mixture from the transfer path to mix with fuel for the next cylinder in the firing order.

* * * * *